United States Patent [19]

Novak et al.

[11] 4,353,202

[45] Oct. 12, 1982

[54] MANUAL APPARATUS FOR THREADING-IN TEXTILE APPARATUS

[75] Inventors: Peter Novak, Winterthur; Hermann Gasser, Frauenfeld, both of Switzerland

[73] Assignee: Rieter Machine Works Ltd., Winterthur, Switzerland

[21] Appl. No.: 185,014

[22] Filed: Sep. 8, 1980

[30] Foreign Application Priority Data

Sep. 28, 1979 [CH] Switzerland ..... 8767/79

[51] Int. Cl.[3] ..... D01H 17/00; D01H 15/00

[52] U.S. Cl. ..... 57/279; 57/67

[58] Field of Search ..... 57/67–71, 57/279, 280

[56] References Cited

U.S. PATENT DOCUMENTS

| | | | |
|---|---|---|---|
| 3,691,744 | 9/1972 | Dubois | 57/279 |
| 3,936,997 | 2/1976 | Marzoli | 57/279 |
| 4,026,095 | 5/1977 | Kobatake et al. | 57/279 |
| 4,047,372 | 9/1977 | Horstmann et al. | 57/279 |
| 4,119,244 | 10/1978 | Funke . | |
| 4,120,142 | 10/1978 | Franzen | 57/279 |

FOREIGN PATENT DOCUMENTS

| | | |
|---|---|---|
| 123998 | 1/1901 | Fed. Rep. of Germany . |
| 494272 | 3/1930 | Fed. Rep. of Germany . |
| 902946 | 1/1954 | Fed. Rep. of Germany . |
| 1217828 | 1/1967 | Fed. Rep. of Germany . |
| 1289470 | 2/1969 | Fed. Rep. of Germany . |
| 2559423 | 3/1977 | Fed. Rep. of Germany . |
| 907402 | 10/1962 | United Kingdom . |

*Primary Examiner*—John Petrakes

*Attorney, Agent, or Firm*—Werner W. Kleeman

[57] ABSTRACT

The present invention is concerned with threading-in textile materials, such as a yarn, a roving or similar textile or filamentary material, into an enclosed duct or the like. The threading-in of the textile material is accomplished by manually operating a manual apparatus which functions as a pump. In this way there can be avoided the use of expensive and complicated devices presently provided for threading-in textile materials as is known. The invention is astonishingly simple, the manual apparatus is easy and convenient to use, readily transportable and its cost is exceedingly modest.

5 Claims, 3 Drawing Figures

MANUAL APPARATUS FOR THREADING-IN TEXTILE APPARATUS

BACKGROUND OF THE INVENTION

The present invention relates to a new and improved method of threading-in textile materials, a manual apparatus for implementing the method, and the use of the method and manual apparatus for the threading-in of textile materials.

More specifically, the invention concerns a method of threading-in textile materials, such as in the form of a yarn, thread, roving or in a similar filamentary form, into an enclosed duct or the like of a textile processing machine. The starting end of the textile material is brought to one end of the duct and air is moved through the duct, this air thus entraining and carrying along the textile material. The invention also concerns apparatus for the performance of the method, wherein there is provided a chamber or compartment, the volume of which can be altered by performing a manual operation. The manually operated apparatus comprises an air inlet opening and an air outlet opening, each such opening being controlled by a related valve.

During the processing of textile materials, in many instances it is necessary that a yarn, thread, roving or similar textile materials, be passed through an enclosed duct or channel or the like. In these arrangements, the threading-in of the textile material into the duct always is a rather complicated procedure.

Therefore, in German Pat. No. 902,946 there has been taught to the art a manual apparatus which comprises a flexible steel wire provided at its front end with a ball or spherical element. At this ball-shaped end of the steel wire there is attached the thread or yarn or the like which is to be drawn through the duct. Also, in German Pat. No. 1,217,828 there is disclosed a threading-in wire. Such type of threading-in operations are time-consuming and in many cases are not usable at all.

In U.S. Pat. No. 4,120,142 there is disclosed a blowing nozzle arrangement which, when activated, generates an air stream for the purpose of threading-in the textile material. During use of this apparatus the yarn or thread or the like must be brought to one entry opening of the duct, is then sucked through a first portion of the duct, and is blown through another portion thereof. Hence, this prior art arrangement requires a reservoir of compressed air and a rather complicated device for the blowing nozzle arrangement and for its control and setting. Hence, this equipment is quite expensive and complicated. The same considerations equally apply for a similar designed piece of equipment as disclosed in German patent publication No. 1,289,470.

According to the teachings of German patent publication No. 2,437,857 a suction operation is exclusively employed for the threading-in of a yarn or thread. With this equipment and method there are used motors, electrical switches for actuating such motors and further equipment components, so that also in this case there is present an extremely expensive and complicated arrangement.

SUMMARY OF THE INVENTION

Therefore, with the foregoing in mind it is a primary object of the present invention to provide a new and improved method of, and apparatus for, threading-in textile material into a predetermined element, typically a duct or the like, in a manner not associated with the aforementioned drawbacks and limitations of the prior art proposals.

Another and more specific object of the present invention aims at avoiding the disadvantages and limitations of the prior art proposals heretofore discussed, and providing specifically a new and improved method of threading-in a textile material and a manually operated apparatus for use in practising the method, wherein the threading-in of the textile material can be accomplished in an extremely easy and efficient manner, and the manual apparatus used for threading-in of the textile material is extremely simple in construction and design, easy to use, extremely reliable in operation, not readily subject to breakdown or malfunction, requires a minimum of maintenance and servicing, and is exceedingly economical to manufacture.

Now in order to implement these and still further objects of the invention, which will become more readily apparent as the description proceeds, the method of threading-in a textile material into a closed channel or duct of a textile machine, contemplates providing a manual apparatus functioning as a pump. This manual apparatus possesses an air inlet or entry location and an air exit or outlet location, through each of which locations the air passes. One of these air passage locations is coupled with one end of the duct, the manual apparatus is manually actuated, and thus the air is moved through the duct, and thus, the textile material is threaded into the duct.

As to the manual apparatus itself which can be beneficially used for the practice of the method aspects, such is manifested by the features that at the air passage point or location which is to be coupled with the duct there is connected one end of a connection element, the other end of which is provided with a sealing element.

Finally, the use of the method and the manual apparatus is manifested that such is accomplished on a flyer of a spinning preparatory machine containing an enclosed duct.

The invention is particularly manifested by its astonishing simplicity. The manual apparatus can be carried without any difficulty as a portable unit by the machine operator or plant personnel of the mill. Furthermore, the manual apparatus can be operated with one hand. Therefore, it is both easily transportable and convenient to use. The complicated arrangements and designs, heretofore particularly provided with the prior art devices, are dispensed with. As a result, considerable savings in costs are realized. The threading-in operation requires an extremely short amount of time. To carry out the threading-in of the textile material, it is sufficient to bring the starting end of the textile material which is to be threaded-in to the duct to the region of a selected opening of the duct or else to insert a short length of the textile material into such opening. Then, the manual apparatus is operatively coupled with the duct, for instance by placing such apparatus into contact with the duct and then there are generated air pulses by applying a few pumping movements at the manual apparatus. Owing to the generated air pulses the textile material, whether such be a roving, yarn or thread is positively moved through the duct. Hence, the invention permits threading-in of textile materials, such as threads, yarns, rovings or the like, through an enclosed duct in a most simple manner and with minimum effort.

The manual apparatus can be designed in a manner such that when used it can produce a suction action or a blowing action. Since two valves are provided, it is additionally possible to achieve the beneficial result that the air moves only in one direction during such time as the manual apparatus is operated. Thus, there is precluded any annoying pull-back or retracting of the textile material, such as a thread or a yarn, which has been partially threaded into the duct due to air flowing in the reverse direction during the threading-in operation. Therefore, it is also possible to thread yarns, threads or rovings through relatively extended or lengthy ducts. With this process, in comparison to the threading-in of the textile material through a duct of normal length, it is only necessary to carry out additional pumping movements to take into account the greater duct length.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross-sectional side view of a manual apparatus according to a first embodiment for threading-in a textile material into a duct or the like; and FIG. 3 is a cross-sectional side view of a second embodiment of manual apparatus for threading-in a textile material into a duct or the like.

DETAILED DESCRIPTION OF THE PREFERRED EMBODIMENTS

Figure 1:
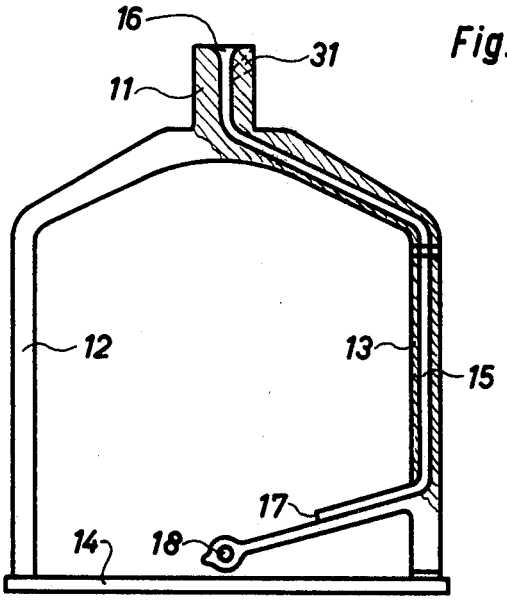
FIG. 1 is a cross-sectional view of a flyer, viewed from the side, of a spinning preparatory machine.

Describing now the drawings, in FIG. 1 there is shown by way of example and not limitation a flyer which will be seen to comprise a hollow shaft 11 which is rotatably supported in a conventional bearing which therefore has not been particularly shown. Extending from the hollow shaft of the flyer 11 are two flyer arms 12 and 13. These flyer arms 12 and 13 are held at their ends by a ring member or other suitable connection element 14. A substantially tubular, enclosed duct or channel 15 extends from the shaft 11, where there is located one of the openings 16 of the duct 15, through the arm or arm member 13, to the other opening 17 of such duct or channel 15.

During operation of the flyer textile material, such as a fiber sliver, or roving, respectively, is delivered from a suitable standard drafting arrangement, and then such textile material enters the duct or channel 15 by means of the opening 16. The roving which has been processed in this manner then again emerges out of the duct 15 through the other opening 17, passes through a thread guide 18 and is then wound on to a conventional spindle (not shown).

At the start of a spinning process, or in the event the roving breaks during system operation, then the roving-like or yarn-like textile material must again be rethreaded into the duct 15. This is accomplished according to the present invention by using a novel manually operated apparatus, sometimes simply referred to herein as a manual apparatus.

Figure 2:
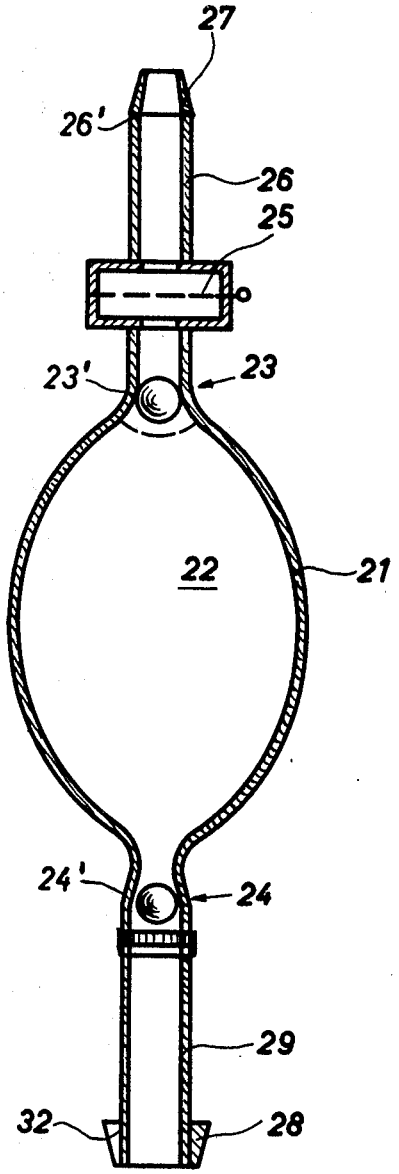

A first exemplary embodiment of textile material threading-in apparatus has been shown in FIG. 2 and will be seen to comprise a compartment or chamber 22 bounded by a bellows 21. This bellows 21 or equivalent structure at least partially consists of an elastic material, typically for instance rubber. At an air inlet opening 23, defining an air throughpassage or passage location, which is formed by a one-way or non-return valve 23', for instance a ball valve, air is only capable of entering the chamber or compartment 22. On the other hand, a second one-way or non-return valve 24', again constituted by a ball valve for instance and defining an air passage or throughpassage location, similarly permits the flow of air in only one direction, and ensures that the air can emerge from the chamber 22 only at the air outlet opening 24. Upstream of the air inlet valve 23' as viewed in the direction of air flow, there is arranged an air filter 25 or equivalent structure. At the air inlet opening 23 there is arranged a connecting element 26 which is provided at its free end 26' with a sealing element 27. At the air exit or outlet location 24 there is arranged a second connecting element 29 which also is provided with a sealing element 28 or equivalent structure.

Now in order to thread the textile material into the duct 15 of the exemplary illustrated flyer of the arrangement of FIG. 1, the starting end of the textile material which is to be threaded is brought to the region of the opening 16 or is inserted over a short length of such thread material into this opening 16 constituting a thread-in opening. The sealing element 27 of the manual apparatus is then inserted into the duct opening 17 or is brought into contact therewith and thus operatively coupled in flow communication with the duct 15. Thereafter, the bellows 21 is operated repeatedly by manually compressing together and releasing the same. During compression of the bellows 21 the air escapes through the air outlet opening 24 constituted by the air outlet valve 24' and as the bellows 21, under the action of its elasticity, springs elastically back into its original shape, air is sucked-up and enters through the air inlet opening 23 formed by the air inlet valve 23'. Thus, the air only flows in one direction during the pumping action, and there are generated pulse-type air movements or surges under the action of which the textile material, after having been brought into contact with or having been inserted partially into the duct opening 16, is positively sucked through the length of the duct 15 and subsequently emerges from the duct opening 17. To avoid that the textile material will be caught in the manual apparatus, particularly in the air inlet opening 23 formed by the valve 23', there is advantageously provided the aforementioned air filter 25. This air filter 25 prevents the textile material from entering the interior of the manual apparatus. Additionally, the air filter 25 retains any contaminants or other foreign materials which are possibly still present in a manner such that there is ensured for a prolonged trouble-free operation of the valves 23' and 24'.

It is particularly advantageous if the connecting element 26 is formed, at least in part, and then advantageously at the immediate vicinity of the filter 25 of a suitable transparent material, so that there is possible visual control of the completed threading-in of the textile material into the duct 15.

Instead of working with the suction action of the manual apparatus it is also possible to utilize the blowing action thereof. For this operating mode there can be provided at the flyer of FIG. 1 an inclined arranged opening or port 31. In this case the sealing element 28 is operatively coupled with such opening 31. Once again, the starting portion of the texile material is brought into contact with or a small length thereof is inserted into the duct opening 16. By repeatedly pressing and releasing the bellows 21 there are generated pulse-like air surges or a pulse-type airflow which is forced through the duct 15, by means of which there is entrained the textile material, for instance the roving, and the same is then threaded into the duct 15.

If a thread or yarn-like textile material is present and if a blowing action is used for the threading-in operation of such textile material, then it is possible to dispense with the use of an inclined opening analogous to the opening or port 31. Instead of this opening 31 there could be provided at the sealing element 28 a notch, generally represented by reference character 32 in FIG. 2. Now for threading-in of the thread-like textile material the same is inserted into this notch 32 and the sealing element 28 is applied to the duct inlet 16. Hence, the thread-like textile material, upon actuation of the bellows 21, is entrained and threaded-in by the generated air pulses or surges.

It should be apparent from the illustration of FIG. 2 that if the bellows or bellows means 21 of the manual apparatus is compressed, then the air will flow out at the air outlet opening 24 of the valve 24', and as the bellows 21 returns back into its original shape then air will be sucked-in at the air inlet opening 23 defined by the air inlet valve 23'. When using a rubber-like or elastomeric bellows 21 the suction action is therefore governed by the elasticity of the bellows 21 and cannot exceed a value which is determined by this bellows 21. On the other hand, threading-in of the textile material by way of a suction action is more easily accomplished, since in that case it is possible to dispense with the provision of the previously discussed opening or port 31 or the notch 32 or equivalent structure.

Figure 3:
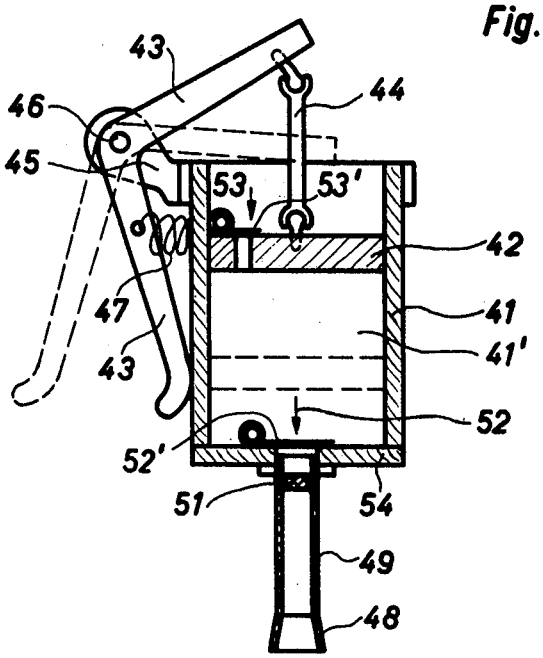

Finally, in FIG. 3 there is shown a further embodiment of manual apparatus for threading-in textile material, wherein in this case the suction pulses are generated by pressing or squeezing the manual apparatus, and thus the suction pulses can be relatively intensified by more forcefully or rigorously operating the manual apparatus. In particular, there will be seen that there is provided a cylinder 41 within which there moves to-and-fro or reciprocates a piston 42. This piston 42 and an actuation or activating lever 43 are connected by means of a piston rod 44 with one another, wherein this piston rod 44 is hingedly connected or linked to both of these elements 42 and 43. The actuation lever 43 is supported by an arm or bracket 45 or equivalent structure and is pivotable between two end positions about a pivot shaft 46. One of these end positions has been indicated with solid lines and the other end position with broken lines. The corresponding end positions of the reciprocatable piston 44 are likewise shown in analogous manner by solid and broken lines. A pressure or compression spring 47 tends to move the actuation lever 43 into the position indicated with broken lines. Furthermore, there is provided a preferably transparent connecting or connection element 49 equipped with a sealing element 48 and an air filter 51. The air through-passage or passage locations 52 and 53 are defined by the air valves 52' and 53', for instance flap valves or other equivalent valve structure, which ensure that the air only can enter at the air inlet point, defined by the air passage location 52, and such air can exit or escape only at the air outlet point, defined by the other air passage location 53. One end of the cylinder 41 is limited by an end cylinder wall 54. When the manual apparatus of FIG. 3 is used with the flyer arrangement of FIG. 1, for instance, it should be evident that the manual apparatus is connected at the sealing element 48 thereof with the opening 17 and the fiber material is introduced at the opening 16. Of course, if the fiber material is paid-off from a not particularly illustrated bobbin, then it would also be conceivable to thread the channel 15 in the reverse direction, i.e. from the bottom towards the top, and in such case the sealing element 48 of the manual apparatus would be placed at the opening 16 of the channel 15 and the fiber material would be introduced into the opening 17.

By pressing upon the actuation lever 43 the piston 42 is moved upwardly within the cylinder 41. Consequently, the volume of the cylinder space or chamber 41' which is defined by the cylinder 41, the piston 42 and the end wall 54, is increased. This causes sucking-up of air, so that air flows through the one-way valve 52' at the air entry location 52 into the cylinder chamber or space 41'. Upon release of the actuation lever 43 the compression or pressure spring 47 causes the piston 42 to again move downwardly into the phantom or broken line position, with the result that the air which previously was sucked into the chamber 41' is now forced out through the air exit or outlet valve 53' at the air outlet location 53. By repeating the operations of actuating the lever 43 and releasing the same the piston 42, as should be readily evident, is reciprocated within the cylinder 41 so that air pulses are produced which act upon the textile material, for instance in the form of a yarn, roving or the like and this textile material is then carried on through the enclosed duct, such as the duct 15 of the arrangement of FIG. 1, and is then threaded through such duct in the manner previously explained.

While there are shown and described present preferred embodiments of the invention, it is to be distinctly understood that the invention is not limited thereto, but may be otherwise variously embodied and practiced within the scope of the following claims. Accordingly,

What we claim is:

1. A manually-operated apparatus for threading-in a textile material into an enclosed duct of a textile processing machine, comprising:

means defining a chamber whose volume can be manually altered;

means defining an air inlet opening for said chamber;

means defining an air outlet opening for said chamber;

a respective valve for controlling each said air inlet opening and said air outlet opening of said chamber;

each of said air inlet opening and air outlet opening defining respective air passage locations;

a connecting element having opposed ends;

one end of said connecting element being connected with the air passage location intended to be operatively coupled with said duct; and the other end of said connecting element being provided with a sealing element.

2. The manually-operated apparatus as defined in claim 1, further including:

air filter means provided upstream, as viewed with respect to the direction of airflow, of said air inlet opening.

3. The manually-operated apparatus as defined in claim 2, wherein:

the connecting element is at least partially formed of transparent material at a location between said air filter means and said sealing element.

4. The manually-operated apparatus as defined in claim 1, wherein:

said means defining said chamber includes wall means composed at least in part of an elastic material having an elastic stress;

said wall means being capable of being pressed manually against said elastic stress so as to reduce the volume of said chamber.

5. The manually-operated apparatus as defined in claim 1, wherein:

said means defining said chamber comprises a cylinder bounded at one end by a cylinder wall;

a piston manually movable within said cylinder;

means for manually operating said piston;

said air passage locations being provided at said cylinder end wall and said piston, respectively;

said means for operating said piston comprising an actuation lever operatively coupled with said piston; and the volume of said chamber can be increased by pressing upon said actuation lever.

* * * * *